United States Patent [19]

Gregoli

[11] 4,075,081

[45] Feb. 21, 1978

[54] FLUIDIZED BED HYDRORETORTING OF OIL SHALE

[75] Inventor: Armand A. Gregoli, Tulsa, Okla.

[73] Assignee: Cities Service Company, Tulsa, Okla.

[21] Appl. No.: 817,403

[22] Filed: July 20, 1977

Related U.S. Application Data

[63] Continuation-in-part of Ser. No. 605,117, Aug. 15, 1975, abandoned.

[51] Int. Cl.[2] ..... C10G 1/02

[52] U.S. Cl. ..... 208/11 R

[58] Field of Search ..... 208/11 R

[56] References Cited

U.S. PATENT DOCUMENTS

| | | | |
|---|---|---|---|
| 2,550,432 | 4/1951 | Thompson | 208/11 R |
| 2,639,982 | 5/1953 | Kalbach | 208/11 R |
| 3,117,072 | 1/1964 | Eastman et al. | 208/11 R |
| 3,281,349 | 10/1966 | Evans | 208/11 R |
| 3,489,672 | 1/1970 | Schulman et al. | 208/11 R |
| 3,565,751 | 2/1971 | Hoerstra | 208/11 R |

*Primary Examiner*—Delbert E. Gantz
*Assistant Examiner*—James W. Hellwege
*Attorney, Agent, or Firm*—George L. Rushton

[57] ABSTRACT

Oil shale, crushed to about 70 mesh size (300 microns or less), is slurried with a recycle stream from the processing of the reactor effluent. The slurry is then heated and charged, along with hydrogen, to an upflow, fluidized bed reactor. The kerogen in the shale undergoes hydroretorting, giving a $C_1$–650° F. range of products. The spent shale is removed with and separated from the reactor overhead effluent.

5 Claims, 1 Drawing Figure

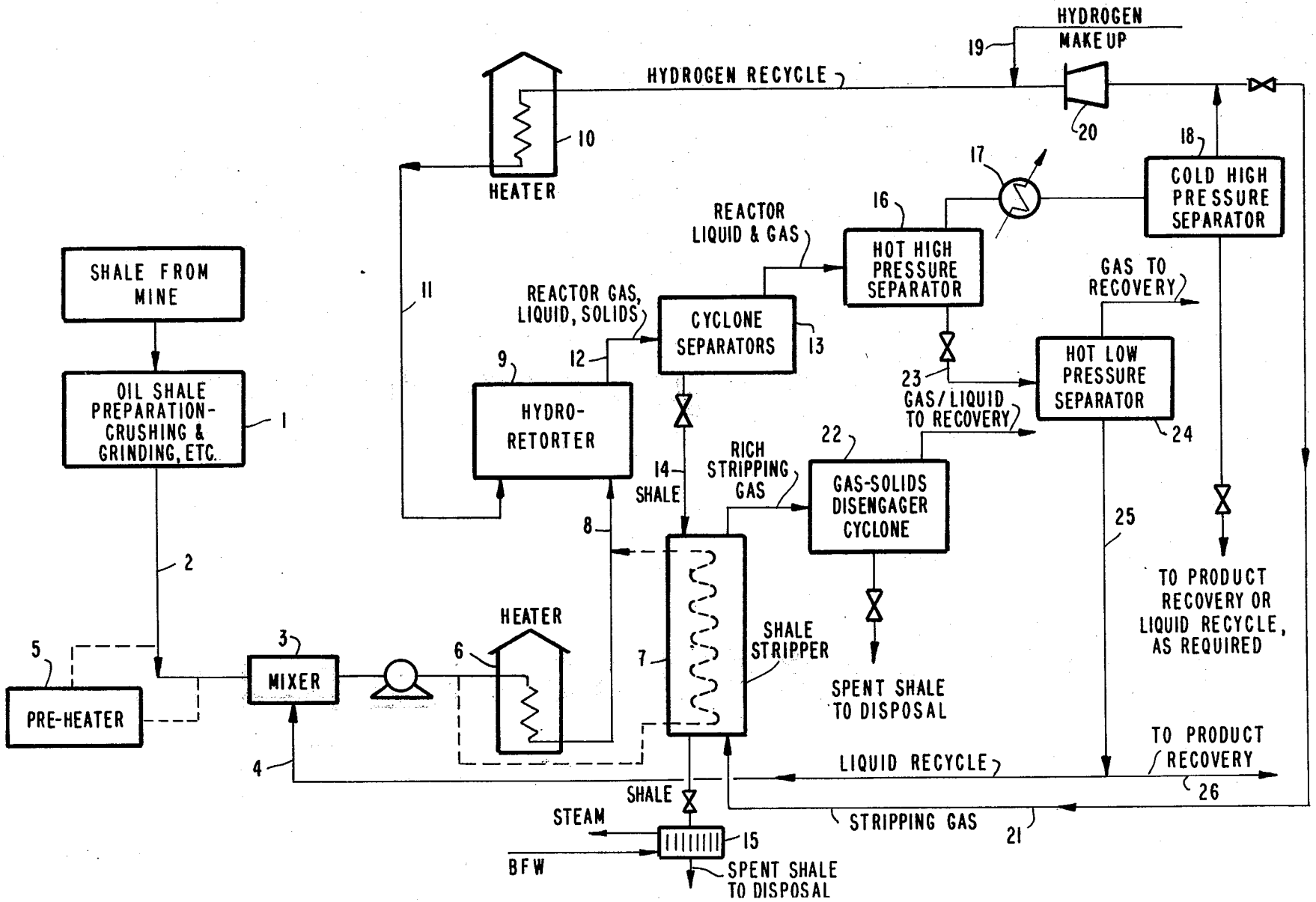
HYDROGEN MAKEUP
19
20
COLD HIGH PRESSURE SEPARATOR
18
17
HOT HIGH PRESSURE SEPARATOR
16
GAS TO RECOVERY
HOT LOW PRESSURE SEPARATOR
24
23 GAS/LIQUID TO RECOVERY
25
TO PRODUCT RECOVERY OR LIQUID RECYCLE, AS REQUIRED
TO PRODUCT RECOVERY
26
21
HYDROGEN RECYCLE
REACTOR LIQUID & GAS
CYCLONE SEPARATORS
13
GAS-SOLIDS DISENGAGER CYCLONE
22
SPENT SHALE TO DISPOSAL
LIQUID RECYCLE
STRIPPING GAS
RICH STRIPPING GAS
SHALE STRIPPER
7
14 SHALE
15
SPENT SHALE TO DISPOSAL
SHALE
STEAM
BFW
10
HEATER
REACTOR GAS, LIQUID, SOLIDS
12
HYDRO-RETORTER
9
8
HEATER
6
11
MIXER
3
4
SHALE FROM MINE
OIL SHALE PREPARATION-CRUSHING & GRINDING, ETC.
1
2
PRE-HEATER
5

FLUIDIZED BED HYDRORETORTING OF OIL SHALE

BACKGROUND OF THE INVENTION

This is a continuation-in-part of my co-pending application, Ser. No. 605,117, filed Aug. 15, 1975 and now abandoned.

This invention concerns the upgrading of oil shale. More particularly, it concerns a process for extracting oily constituents from oil shale. The utility of the invention lies in the production of petroleum-like products from oil shale. Prior art processes for extracting oil from oil shale have typically been of two types: underground, in situ extraction by heat, or above-ground retorting of mined shale. The retorting processes generally obtain the needed process heat by combustion of a portion of the hydrocarbons extracted from the kerogen or from combustion of the carbonaceous residue remaining on the shell after pyrolysis. These prior art processes are more fully described in an article on oil shale technology in Vol. 18 of "Kirk-Othmer Encyclopedia of Chemical Technology" (Interscience-John Wiley; New York).

The in situ method of obtaining shale oil has the disadvantages of low recovery of yield and the consumption of an appreciable portion of the oily constituent of the shale in order to furnish process heat for pyrolysis of the deposit. Similarly, most above-ground retorting methods often use pyrolysis temperatures that involve combustion products and decomposition of the carbonate mineral constituent of the shale, thus requiring additional treatment of the effluent gas-vapor stream to remove $CO_2$. Typically, the recovery of desirable products from these prior methods is about 60 to 100% of the Fischer Assay.

Prior art processes closer to the present invention are exemplified by U.S. Pat. No. 2,639,982 (Kalbach) and U.S. Pat. No. 3,565,751 (Hoekstra). Kalbach slurries particulate carbonaceous material with a hydrocarbon oil and solid hydrogenation catalyst and contacts the slurry with hydrogen in a reaction zone containing a fluidized bed of carbonaceous material. At the operating conditions in the reaction zone, oil is produced and is hydrogenated to form product vapors. The products are discharged overhead and processed to give desirable gaseous and liquid products, while the excess solid residue (char), apart from that used for the fluidized bed or in the reactor, is discharged from the bottom of the reactor. Hoekstra pyrolyzes oil shale and hydrogenates shale oil in a single reaction zone. Crushed oil shale is fed to a lock hopper system, utilizing hydrogen as a carrier, pre-heated, and then fed to the reactor, which contains a hydrogenation catalyst. Heated hydrogen heats the shale to pyrolysis temperature and hydrogenates the liberated shale oil. Hydrogen, oil vapor, and spent shale particles exit the top of the reactor, utilizing hydrogen as the fluidizing agent. The catalyst can be removed from the bottom of the reactor and regenerated. The oil vapor is processed to yield the desired fractions. Thus, Hoekstra teaches a "dry" method of treating the oil shale. Furthermore, Hoekstra indicates that particle size is not critical, since pyrolysis of the shale will cause a substantial reduction of the size of the particles. Hoekstra does not concern himself with foreign material in the feed, such as rock, which does not decrepitate.

SUMMARY OF THE INVENTION

My invention eliminates the retorting stage of conventional shale upgrading, by subjecting crushed shale to a hydroretorting treatment in an upflow, fluidized bed reactor, such as that used for the hydrocracking of heavy petroleum residues. Broadly, the process for extracting oil from oil shale comprises the steps of: a) crushing the shale, b) mixing the crushed shale with a hydrocarbon liquid to give a pumpable slurry and heating at least one of the reactor feed component streams, c) introducing the slurry, along with a hydrogencontaining gas, into an upflow, fluidized bed reactor at a superficical fluid (liquid plus gas) velocity sufficient to move the mixture upwardly through the reactor, d) hydroretorting the oil shale, e) removing the reaction mixture from the reactor as total overhead effluent, and f) separating the reactor effluent into two or more components.

This process, in eliminating conventional thermal retorting, concurrently eliminates the internal combustion feature common to several of the retort systems. And since carbonate decomposition, common to retorting, is minimized in my process by the use of reaction temperatures lower than those used in retorting, the gas product from my process has a greater heating value, due to a minimum of $CO_2$ resulting from combustion and carbonate decomposition. Also, due to the exothermic nature of the hydroretorting reactions, less input in energy is required per barrel of product obtained. The products, having less unsaturation than products obtained by prior art retorting processes, have improved stability. There is no upper or lower limitation on the grade of oil shale that can be treated. A liquid recycle stream is used as a primary means of heating incoming feed material, as opposed to the mechanical movement and mixing of hot spent shale or hot metal balls of prior art retorting processes. The yield (per ton of feed material) from this process is higher than for prior art processes.

It is to be noted that the kerogen portion of the oil shale is subjected to hydroretorting, as opposed to thermal cracking or decomposition found in prior art processes.

The Fischer Assay procedure does not measure the total hydrocarbon content of the shale. It is a laboratory test for estimating the recoverable oil in a conventional retort system. The spent shale from the assay or from conventional retort systems typically contains about 5% organic carbon. This represents a potential loss of recoverable hydrocarbons. Since my system involves hydroretorting rather than thermal cracking, the coke or carbon obtained from prior art processes is recovered as an improved yield of the hydrocarbon products. Also, the spent shale obtained from the separation step can be considered as ore for a further metallurgical process.

DESCRIPTION OF DRAWING

The above described process and the advantages of the invention are more fully understood by referring to the drawing, which shows one aspect of the process.

DETAILED DESCRIPTION OF THE INVENTION

The process concerns the hydroretorting of oil shale. The term "hydroretorting" concerns the process of subjecting oil shale particles, in particular the kerogen portion of oil shale, to reaction temperatures and pressures typically found in the processing of petroleum residues. "Hydroretorting" involves the use of hydrogen as a reactant with kerogen, and terms such as "hydrocracking", "hydrotreating", "hydrodesulfurization", and "hydrodenitrification" are or can be involved in the hydroprocessing treatment taking place in the reactor. Since there are many complex reactions involved, I prefer to use the term "hydroretorting" as the general name for the process.

Oil shale, such as is found in deposits in the Rocky Mountain region, can have various grades, or amounts of recoverable oil and materials, and this invention is designed to handle the gamut of grade. Naturally, the economics of the process are effected by the grade, but this factor does not diminish the utility of the invention.

In order to be accommodated in the process of the invention, the feed material is ground to a "fine" size, of the order of about 300 microns of less, with a more preferred size being 200 microns or less. In typical grinding procedures, when one obtains a 200 micron particle size, smaller size particles, even to a sub-micron range, are also obtained. Although the process can accommodate sub-micron sized particles, they are more difficult to separate from the reaction effluent. Therefore, a usable range of from 10 microns to about 300 microns is disclosed, with a more preferred range of about 50 microns to about 200 microns. The major reason for crushing the shale is to obtain a pumpable slurry at the desired operating conditions, and thus the crushed material is mixed with a liquid to form this slurry as feed to the hydroretorting reactor. The preferred liquid is a hydrocarbon and can be taken from a wide range of choices, such as various cuts from refinery petroleum streams, crude oil, synthetic oil, and atmospheric residues. Since the liquid is to be used in a reactor in which oily constituents are extracted from the kerogen portion of the shale, it is natural that the liquid portion of the feed be of a hydrocarbon nature. A very obvious and preferred liquid is a recycle stream from the downstream separation of the reactor effluent, such as the stream from the hot, low pressure separator of the process. Such a recycle liquid forms a pumpable slurry with the feed shale and has a known reaction rate in the reactor. In addition, the recycle liquid, by its very nature, furnishes an appreciable portion of the heat necessary for the proper operation of the reactor. The liquid (vol.)/solid (wt.) ratio of the feed slurry can vary from a dilute mixture to a barely-pumpable mixture, depending on the nature of the liquid, the mixing temperature, operating conditions in the reactor, and the desired through-put of the oil shale. Broadly, this ratio can vary from about 5:1 to about 50:1, with a preferred range of from about 10:1 to about 30:1, and a most preferred range of from about 15:1 to about 25:1. For example, a 20:1 liquid/solid ratio means 20 barrels of recycle liquid per ton of oil shale. The slurrying liquid, already at an elevated temperature, is mixed with the crushed oil shale. Since the resultant slurry is not at a sufficient temperature for proper reactor conditions, the slurry mixture can be heated, such as by passing the mixture through a furnace. Alternatively, the recycle liquid and/or hydrogen gas can be heated prior to mixing with the crushed shale, or a variation of heating the gaseous, liquid, and solid feed components can be employed. The temperature of the slurry, at or near the inlet of the reactor, is below or near reactor temperature, since the reaction is exothermic.

The reactor is a typical upflow, fluidized bed reactor using pressures and temperatures as described in U.S. Pat. No. 3,207,688. Typical operating pressures are from about 500 to about 3000 psi, preferably from 800 to about 2500 psi, and most preferably, from about 1000 to about 1500 psi., depending on the hydrogen partial pressure. The operating temperature can vary from about 600 to 900° F., preferably from about 700 to about 850° F., and most preferably about 800° F. The space velocity can vary from about 0.2 to about 0.2, with a preferred space velocity of about 1.0. The space velocity is here defined as tons of fresh shale feed/hour/volume of reactor. The hydrogen flow into the reactor can vary from about 2000 to about 10,000 scf, per ton of shale feed, with a most preferred rate of about 5000 scf, based on one ton of shale feed. Removal of the total reaction mixture in the reactor overhead requires a definite particle size range for the solid materials used. The superficial fluid (liquid plus gas) velocity determines the reactor cross sectional area and is critical to elutriate or carry over the solids as a part of the effluent. The total reactor volume is fixed by space velocity. The hydrogen concentration in the recycle gas stream is not critical, however a specified hydrogen partial pressure is maintained. Hence any hydrogen-rich gas stream can be used, such as an off-gas stream of 65 mole % hydrogen.

The hydroretorted mixture of gases, liquids and solids is withdrawn from the reactor overhead and is separated into various phases and constitutents, according to known technology. The gaseous phase is treated to separate such components as $H_2S$, $NH_3$, and light hydrocarbons from hydrogen, so that the hydrogen can be recycled, along with make-up hydrogen, for use in the process. Similarly, the liquid phase is separated into various cuts similar to those found in a typical refinery, with one or more of the cuts being used as the slurrying liquid for the crushed oil shale. The solid mineral residue, treated to remove a majority of absorbed gaseous and liquid constituents can be used for various purposes, such as fill material for an oil shale deposit, road building material, feed material for a metals extraction process, etc.

Depending upon the analysis of the non-kerogen portion of the oil shale, the crushed shale can have some catalytic properties. Depending upon various factors, such as cost, availability, and conversion level desired, one or more catalysts useful in a hydroretorting process can be added to the feed stream. Such catalysts can be chosen from cobalt, iron, molybdenum, nickel, tungsten, platinum, palladium, naturally occurring clays, etc., as well as combinations of these. Such catalysts, as well as their sulfides and oxides, can be used alone or together with other suitable catalysts and can, if desired, be supported on suitable bases such as alumina or silica-alumina. The size of the added catalyst particle should be comparable with that of the crushed feed shale, that is in the range of about 10–300 $\mu$, preferably 50–200 $\mu$. The concentration of the catalyst added will vary, depending upon reactor conditions, catalytic nature of the feed shale, desired conversion level for one or more reactions occurring in the reactor, etc. Since the catalyst particle size and density are approximately that of the ground shale, when a catalyst is used in the hydroretorter reaction mixture, the overhead effluent is designed to include catalyst particles in the mixture of gases, liquids, and solids. For those skilled in the art, variations of catalyst density and size can be accommodated in this process.

A typical procedure using this process is as follows: oil shale is crushed to the desired particle size in crushing and grinding unit 1. The crushed shale then goes by conduit 2 to a mixer 3, where the shale is mixed with the proper volume of liquid recycle stream from line 4. Alternatively, the crushed shale can go through a preheater 5 where one or more heat exchangers can be used. The slurry from 3 is then pumped to a heater 6, where the temperature of the slurry is raised to approximately that of the desired reactor temperature. Note that the reaction is exothermic and thus the feed temperature is below that of the reactor temperature. If desired, a side-stream of the slurry can be pumped through shale stripper 7 prior to joining line 8 at the entrance to the hydroretorter 9. Hydrogen gas, preheated in heater 10 is fed into the hydroretorter by line 11. The slurry and hydrogen gas travel upwardly through the hydroretorter, leading through line 12. The total effluent goes to a separator 13, such as a cyclone separator, with the liquid and gas phases leaving the top of the separator and the shale leaving the bottom by line 14 and going to shale stripper 7. After leaving the stripper, the shale can go to a further heat exchanger 15 which produces steam. The spent shale then is sent to disposal or for further processing.

The liquid-gas stream leaving the separator enters the hot high pressure separator 16, in which the gas and liquid are separated, with the gas going overhead through a heat exchanger 17 to a cold high pressure separator 18. In separator 18, light ends are separated from the feed and can be sent to product recovery, or a portion can be made available as liquid recycle. The overhead gas stream from 18, containing $H_2S$ and ammonia, can then be sent to a purification zone, not shown, with the residual hydrogen being fed to the hydrogen recycle line. Makeup hydrogen 19 is added to line 11, and this recycle hydrogen stream goes through heater 10 before being fed to the reactor. A compressor 20 is used to pressure the recycle hydrogen stream to the desired value. When the overhead stream from the cold high pressure separator enters the hydrogen recycle stream, a portion of it can also be sent through line 21 as stripping gas, which is then sent through shale stripper 7, leaving as rich stripping gas which then enters gas-solids separator 22. From this separator, an overhead gas-liquid stream is sent to recovery, with solids being discharged to disposal.

The liquid effluent from the hot high pressure separator goes by line 23 to hot low pressure separator 24. An overhead gas stream, typically light hydrocarbons, can be sent to recovery, with the liquid effluent in line 25 being sent to product recovery in line 26 or as liquid recycle in line 4.

EXAMPLE

Following the above procedure, shale is crushed to give particles of 200 microns or less, and one ton per hour of crushed shale feed is mixed with 20 barrels of recycle liquid. The mixture is pumped through a heater and then into the hydroretorter at a space velocity of 1.0 ton of fresh shale feed/hour/volume of reactor. The reactor cross-section area is designed to provide the superficial fluid (gas plus liquid) velocity sufficient to move the reaction mixture upwardly through the reactor. The total reactor volume is fixed by space velocity. Hydrogen is fed to the reactor at a rate of 5000 scf/ton of shale feed. The reactor hydrogen partial pressure is about 1000 psi, and the temperature is about 800° F. The total effluent goes to a first separator, with an overhead of a liquid-gas stream and a bottom stream of used shale. The liquid-gas stream is further processed to give the products shown below.

| Feed & Product Inspections | | Basis: 1 ton shale lead | |
|---|---|---|---|
| Feed: | lbs/ton | gal/ton | scf/ton |
| shale | 2000.0 | | |
| hydrogen | 11.2 | | 2000(consumed) |
| Fischer Assay | | 30* | |
| | 2011.2 | | |

| Products | lbs/ton | gal/ton | ° API | SCF/ton |
|---|---|---|---|---|
| Spent shale | 1686.1 | | | |
| $NH_3$ | 5.7 | | | 120 |
| $H_2O$ | 17.0 | | | 338 |
| $H_2S$ | 2.5 | | | 26 |
| $C_1$ | 7.5 | | | 168 |
| $C_2$ | 5.1 | | | 61 |
| $C_3$ | 4.9 | | | 40 |
| $C_4$ | 8.0 | 1.6 | | |
| $C_5$–180° F | 15.7 | 2.9 | 83 | |
| 180–400° F. | 64.9 | 10.2 | 53.8 | |
| 400–650° F. | 193.8 | 27.3 | 34.3 | |
| 650+ | 0.0 | — | — | |
| | 2011.2 | 42.0 | | |
| $C_1,C_2,C_3$ | 17.5 | — | — | 269 |
| $C_4$+ | 282.4 | 42.0 | 43.7 | |
| Inspections, $C_4$+ fraction | | | | |
| Gravity, ° API | | | 43.7 | |
| Pour Point, ° F | | | +20 | |
| Sulfur, wt% | | | 0.1 | |
| Nitrogen, wt% | | | 0.5 | |
| Viscosity, SSU at 122° F | | | 35 | |

*(sulfur=0.8 wt %, Nitrogen 2.0 wt %)

A catalyst, such as a hydrogenation or hydrocracking catalyst, comparable in size to the crushed shale, can be added to the slurry entering the hydroretorter, or the catalyst can be added directly to the reactor. A desirable catalyst is cobalt-molybdenum oxide on an alumina support.

It is noted from the above example that 42 gallons of hydrocarbon products are obtained from one ton of shale. Since the Fischer Assay is 30 gallons per ton, this procedure results in a 140% yield based on the Fischer Assay. As mentioned previously, this high yield is attributed to the almost-complete conversion of kerogen into usable hydrocarbons, with a minimum of coke formation.

I claim:

1. A process for extracting oil from oil shale comprising (a) crushing the shale to a particle size of from about 10 $\mu$ to about 300 $\mu$, (b) mixing the crushed shale with a hydrocarbon liquid to give a pumpable slurry and heating at least one of the reactor feed component streams, (c) introducing the slurry, along with a hydrogencontaining gas, into an up-flow, fluidized bed reactor, at a superficial fluid (liquid plus gas) velocity sufficient to move the reaction mixture of gases, liquids, and solids upwardly through the reactor, (d) hydroretorting the oil shale at a reactor temperature of from about 600° to about 900°, at a reactor pressure of from about 500 to about 3000 psi., at a space velocity between about 0.2 and about 2.0 of tons of fresh shale feed/hr./volume of reactor, (e) removing the reaction mixture from the reactor as total overhead effluent, and (f) separating the reactor effluent into two or more component streams.

2. The process of claim 1, wherein (a) the crushed shale has a particle size of from about 50 to about 200 μ., (b) the added hydrocarbon liquid is a hydrocarbon recycle stream from the effluent stream separation process, (c) the liquid/solid ratio of the feed slurry varies from about 5/1 to about 50/1, based on barrels of recycle liquid per ton of feed oil shale, (d) the amount of hydrogen introduced varies from about 2000 to about 10000 scf per ton of feed oil shale, (e) the reactor temperature varies from about 700° to about 850° F., (f) the reactor pressure varies from about 800 to about 2500 psi, and (g) the space velocity is about 1.

3. The process of claim 1 wherein a hydrocracking or hydrogenation catalyst having a particle size and density comparable to that of the crushed shale is added to the reactor, separately from or concurrently with the pumpable slurry and is a portion of the overhead effluent.

4. The process of claim 3, wherein a hydrogenation catalyst, is added to the pumpable slurry.

5. The process of claim 3, wherein the catalyst is a cobalt-molybdenum oxide on an alumina support.

* * * * *